US008089447B2

(12) United States Patent
Song et al.

(10) Patent No.: US 8,089,447 B2
(45) Date of Patent: Jan. 3, 2012

(54) LIQUID CRYSTAL DISPLAY AND DRIVING METHOD THEREOF

(75) Inventors: Hongsung Song, Kyungbuk (KR); Woongki Min, Daegu (KR); Yonggi Son, Kyungnam (KR); Suhyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 544 days.

(21) Appl. No.: 12/314,560

(22) Filed: Dec. 12, 2008

(65) Prior Publication Data

US 2009/0167661 A1 Jul. 2, 2009

(30) Foreign Application Priority Data

Dec. 30, 2007 (KR) ..... 10-2007-0141149

(51) Int. Cl.
*G09G 3/36* (2006.01)

(52) U.S. Cl. ..... 345/100; 345/96; 345/98; 345/99

(58) Field of Classification Search ..... 345/87–100, 345/204, 209, 210–213
See application file for complete search history.

(56) References Cited

U.S. PATENT DOCUMENTS

| | | | | |
|---|---|---|---|---|
| 5,648,793 | A * | 7/1997 | Chen | 345/96 |
| 7,737,935 | B2 * | 6/2010 | Kim | 345/96 |
| 2003/0006948 | A1 * | 1/2003 | Son et al. | 345/87 |
| 2003/0030615 | A1 * | 2/2003 | Maeda et al. | 345/90 |
| 2003/0122765 | A1 * | 7/2003 | Yoon | 345/94 |
| 2005/0083319 | A1 * | 4/2005 | Kodate et al. | 345/204 |
| 2006/0119559 | A1 * | 6/2006 | Jung et al. | 345/96 |
| 2007/0268231 | A1 * | 11/2007 | Kang et al. | 345/100 |

* cited by examiner

*Primary Examiner* — Amare Mengistu
*Assistant Examiner* — Hong Zhou
(74) *Attorney, Agent, or Firm* — Morgan, Lewis & Bockius LLP

(57) ABSTRACT

A liquid crystal display and a method of driving the same are disclosed. The liquid crystal display includes a liquid crystal display panel, a data drive circuit, a gate drive circuit, and a timing controller. The data drive circuit generates a pre-charge data voltage during pre-charge time and generates a real-charge voltage to be displayed on the liquid crystal display panel during real-charge time. The gate drive circuit supplies a first gate pulse synchronized with the pre-charge data voltage to the gate lines during the pre-charge time while shifting a gate pulse in a downward direction and an upward direction depending on an up/down signal, and then supplies a second gate pulse synchronized with the real-charge data voltage to the gate lines from a falling edge of the first gate pulse at intervals equal to or longer than scanning time of 1 line during the real-charge time.

7 Claims, 11 Drawing Sheets

LIQUID CRYSTAL DISPLAY AND DRIVING METHOD THEREOF

This application claims the benefit of Korea Patent Application No. 10-2007-0141119 filed on Dec. 30, 2007, which is incorporated herein by reference for all purposes as if fully set forth herein.

BACKGROUND OF THE INVENTION

1. Field of the Invention

Exemplary embodiments of the invention relate to a liquid crystal display and a method of driving the same. Although the exemplary embodiments of the invention are suitable for a wide scope of applications, they are particularly suitable for preventing direct current (DC) image sticking and stains so as to increase the display quality.

2. Discussion of the Related Art

Active matrix type liquid crystal displays display a moving picture using a thin film transistor (TFT) as a switching element. The active matrix type liquid crystal displays have been implemented televisions as well as display devices in portable devices, such as office equipment and computers, because of the thin profile of the active matrix type liquid crystal displays. Accordingly, cathode ray tubes (CRT) are being rapidly replaced by the active matrix type liquid crystal displays.

If a DC voltage is applied to the liquid crystal display for a long time, image sticking map appear and stains may appear on the display screen of the liquid crystal display. If a DC voltage of the same polarity is applied to a liquid crystal layer for a long time, impurity ions in the liquid crystal layer are separated depending on a polarity of the liquid crystal. Further, ions with different polarities are respectively accumulated on a pixel electrode and a common electrode inside the liquid crystal cells. If a DC voltage is applied to the liquid crystal layer for a long time, the amount of accumulated ions increases. Hence, an alignment layer is degraded and alignment characteristics of the liquid crystal are degraded. In other words, the application of the DC voltage to the liquid crystal display for the long time may cause stains on the display screen. The development of a liquid crystal material with a low dielectric constant or a method for improving an alignment material or an alignment method have been attempted so as to solve the stain problem. However, it takes a long time and a heavy expense to develop a material used in the method. The use of the liquid crystal material with the low dielectric constant may reduce the drive characteristics of the liquid crystal. According to the experimental findings, as the amount of impurities ionized inside the liquid crystal layer increases and an acceleration factor becomes large, a time when the stains are revealed becomes rapider. The acceleration factor may include a temperature, time, DC drive of the liquid crystal, and the like. Accordingly, the stains may worsen at a high temperature or when the DC voltage of the same polarity is applied to the liquid crystal layer for the long time. Because the stains non-uniformly appear between panels manufactured through the same manufacture line, the stain problem cannot be solved only the development of new material or an improvement method of process. A method for suppressing the DC drive of the liquid crystal is effective in solving the stain problem.

SUMMARY OF THE INVENTION

Accordingly, an exemplary embodiment of the invention provides a liquid crystal display and a method of driving the same capable of preventing DC image sticking and stains.

Additional features and advantages of the exemplary embodiments of the invention will be set forth in the description which follows, and in part will be apparent from the description, or may be learned by practice of the exemplary embodiments of the invention. The objectives and other advantages of the exemplary embodiments of the invention will be realized and attained by the structure particularly pointed out in the written description and claims hereof as well as the appended drawings.

In one aspect, a liquid crystal display comprises a liquid crystal display panel including a plurality of data lines, a plurality of gate lines crossing the data lines, and a plurality of liquid crystal cells, a data drive circuit that generates a pre-charge data voltage during pre-charge time and generates a real-charge voltage to be displayed on the liquid crystal display panel during real-charge time, a gate drive circuit that supplies a first gate pulse synchronized with the pre-charge data voltage to the gate lines during the pre-charge time while shifting a gate pulse in a downward direction and an upward direction depending on an up/down signal, and then supplies a second gate pulse synchronized with the real-charge data voltage to the gate lines from a falling edge of the first gate pulse at intervals equal to or longer than scanning time of 1 line during the real-charge time, and a timing controller that inverts a logic state of the up/down signal one or more times during 1 frame period and controls operation timing of the data drive circuit and the gate drive circuit, wherein a polarity of the pre-charge data voltage is opposite to or the same as a polarity of the real-charge data voltage.

In another aspect, a method of driving a liquid crystal display including a liquid crystal display panel including a plurality of data lines, a plurality of gate lines crossing the data lines, and a plurality of liquid crystal cells, the method comprises generating an up/down signal whose a logic state is inverted one or more times during 1 frame period, generating a pre-charge data voltage during pre-charge time and generating a real-charge voltage to be displayed on the liquid crystal display panel during real-charge time, supplying a first gate pulse synchronized with the pre-charge data voltage to the gate lines during the pre-charge time while a gate pulse is shifted in a downward direction and an upward direction depending on the up/down signal, and supplying a second gate pulse synchronized with the real-charge data voltage to the gate lines from a falling edge of the first gate pulse at intervals equal to or longer than scanning time of 1 line during the real-charge time, wherein a polarity of the pre-charge data voltage is opposite to or the same as a polarity of the real-charge data voltage.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Hereinafter, an exemplary embodiment will be described in detail with reference to FIGS. 1 to 11.

Figure 1:
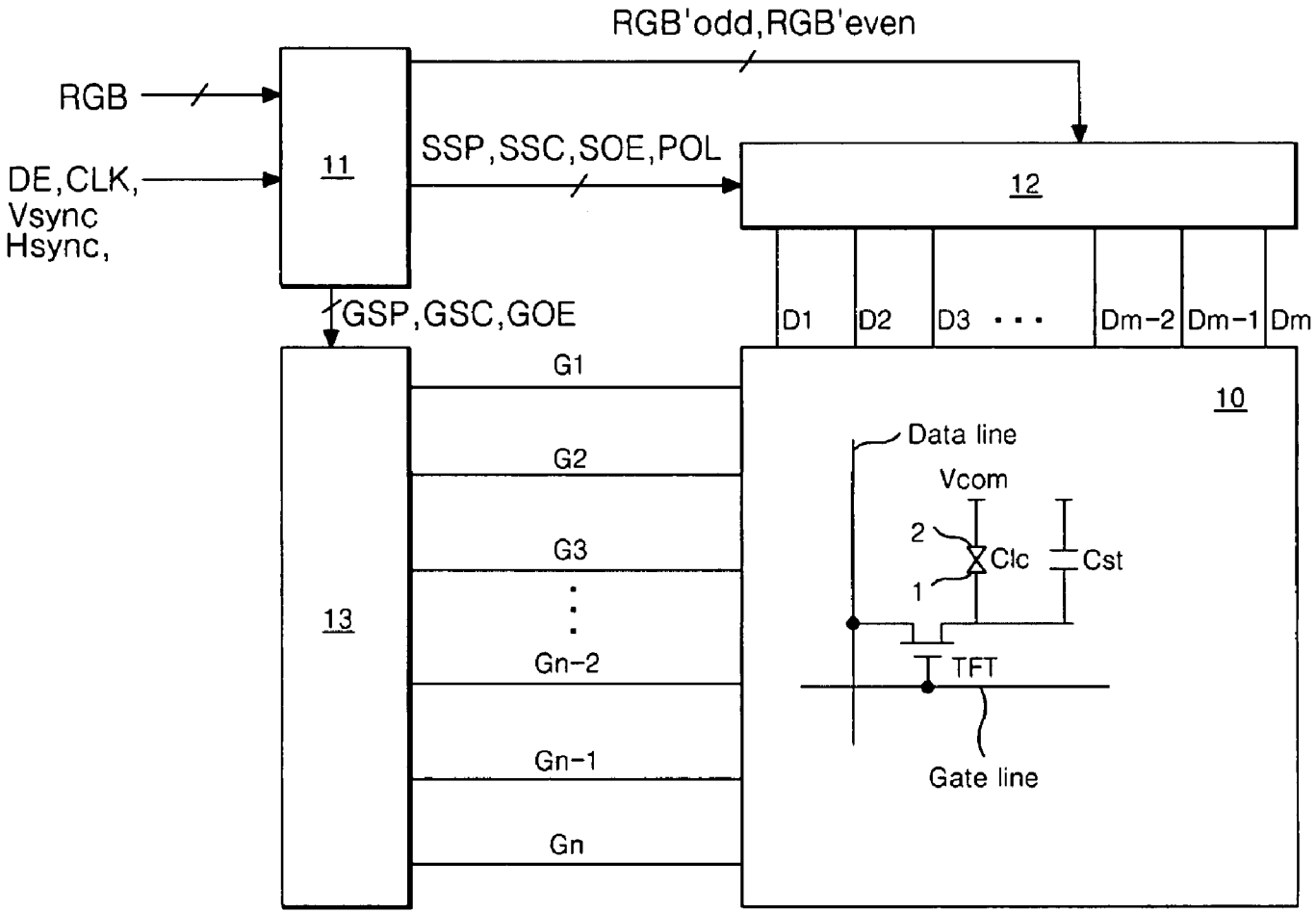
FIG. 1 is a block diagram of a liquid crystal display according to an exemplary embodiment of the invention.
Figure 2:
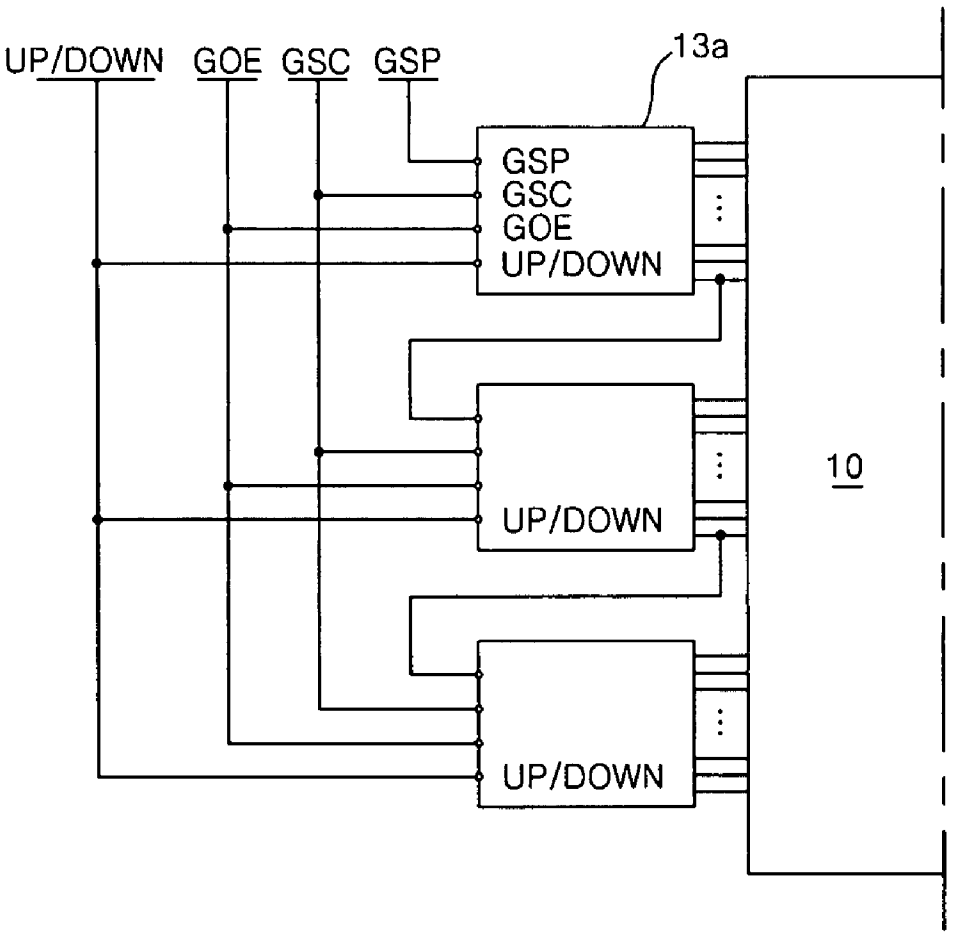
FIG. 2 shows gate drive integrated circuits (ICs) of a gate drive circuit.

As shown in FIGS. 1 and 2, the liquid crystal display according to the exemplary embodiment of the invention includes a liquid crystal display panel 10, a timing controller 11, a data drive circuit 12, and a gate drive circuit 13.

The liquid crystal display panel 10 includes an upper glass substrate, a lower glass substrate, and a liquid crystal layer between the upper and lower glass substrates. The lower glass substrate of the liquid crystal display panel 10 includes m data lines D1 to Dm and n gate lines G1 to Gn crossing each other. The liquid crystal display panel 10 includes m×n liquid crystal cells Clc arranged in a matrix array at each crossing of the m data lines D1 to Dm and the n gate lines G1 to Gn. The liquid crystal cells Clc include a first liquid crystal cell group and a second liquid crystal cell group. The lower glass substrate further includes a thin film transistor TFT, a pixel electrode 1 of the liquid crystal cell Clc connected to the thin film transistor TFT, and a storage capacitor Cst, and the like.

The upper glass substrate of the liquid crystal display panel 10 includes a black matrix, a color filter, and a common electrode 2. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizers having optical axes that cross at a right angle are attached respectively to the upper and lower glass substrates. Alignment layers for setting a pre-tilt angle of the liquid crystal in an interface contacting the liquid crystal are respectively formed on the upper and lower glass substrates.

The timing controller 11 divides digital video data RGB into odd-numbered pixel data RGBodd and even-numbered pixel data RGBeven so as to lower a transmission frequency of the digital video data RGB, and then supplies the data RGBodd and RGBeven to the data drive circuit 12 through 6 data buses. The timing controller 11 receives timing signals, such as vertical and horizontal sync signals Vsync and Hsync, a data enable signal DE, a clock signal CLK, and produces a data timing control signal for controlling operation timing of the data drive circuit 12 and a gate data timing control signal for controlling operation timing of the gate drive circuit 13.

The data timing control signal includes a source start pulse SSP, a source sampling clock signal SSC, a source output enable signal SOE, and a polarity control signal POL. The source start pulse SSP indicates a start pixel on 1 horizontal line to which data will be displayed. The source sampling clock signal SSC directs a data latch operation to the data drive circuit 12 based on a rising or falling edge. The source output enable signal SOE directs an output of the data drive circuit 12. A logic state of the polarity control signal POL is inverted every scanning time of 1 line or scanning time of 2 lines, and a phase of the polarity control signal POL is inverted in each frame period. The polarity control signal POL indicates a polarity of the data voltage that will be supplied to the liquid crystal cells Clc of the liquid crystal display panel 10.

The gate data timing control signal includes a gate start pulse GSP, a gate shift clock signal GSC, a gate output enable signal GOE, an up/down signal UP/DOWN, and the like. The gate start pulse GSP indicates a scan start horizontal line of a scan operation in 1 vertical period during which one screen is displayed. The gate shift clock signal GSC is a timing control signal, that is input to a shift resistor installed in the gate drive circuit 13 to sequentially shift the gate start pulse GSP, and has a pulse width corresponding to a turned-on period of the thin film transistor TFT. The gate output enable signal GOE directs an output of the gate drive circuit 13. The up/down signal UP/DOWN is a control signal indicating an output order of scan pulses.

The timing controller 11 doubles a frequency of the data timing control signal and a frequency of the gate timing control signal and allows a transmission frequency of the digital video data RGB to be two times an input frequency, so that each liquid crystal cell Clc is charged to the data voltage twice during 1 frame period.

The data drive circuit 12 includes a plurality of data drive integrated circuits (ICs). Each data drive IC includes a shift resistor, a latch, a digital-to-analog converter, a buffer, and the like. The data drive circuit 12 latches the digital video data RGBodd and RGBeven under the control of the timing controller 11. Then, the data drive circuit 12 converts the digital video data RGBodd and RGBeven into analog positive and negative gamma compensation voltages to supply the positive and negative gamma compensation voltages to the data lines D1 to Dm. The data drive circuit 12 inverts the polarity of the data voltage in response to the polarity control signal POL. While the data drive circuit 12 outputs the negative polarity data voltage when the polarity control signal POL is in a low logic state, the data drive circuit 12 outputs the positive polarity data voltage when the polarity control signal POL is in a high logic state.

The gate drive circuit 13 includes a plurality of gate drive ICs 13*a*. Each gate drive IC 13*a* includes a shift resistor, a level shifter for shifting an output signal of the shift resistor to a swing width suitable for a TFT drive of the liquid crystal cells Clc, an output buffer, and the like. The gate drive circuit 13 sequentially outputs gate pulses (or scan pulses). More specifically, the gate drive IC 13*a* sequentially outputs the gate pulses in a downward direction traveling from top to bottom of the screen and in an upward direction traveling from the bottom to the top of the screen depending on a logic state of the up/down signal UP/DOWN produced by the timing controller 11.

Because the liquid crystal display panel 10 is scanned in consecutive order in the related art, the gate drive ICs 13*a* sequentially output the gate pulses in the downward direction when the gate drive ICs 13*a* are attached to the left side of the liquid crystal display panel 10. On the other hand, when the gate drive ICs 13*a* are attached to the right side of the liquid crystal display panel 10, a direction of an output terminal of the gate drive IC 13*a* changes. Therefore, the gate drive ICs 13*a* have to sequentially output the gate pulses in the upward direction. As the size of the liquid crystal display panel 10 becomes larger, the gate drive ICs 13*a* are uniformly attached to the left and right sides of the liquid crystal display panel 10 and simultaneously apply the gate pulses to both sides of the gate lines, so as to reduce the delay and voltage drop of the gate pulse. In the related art, the up/down signal UP/DOWN is fixed to a predetermined voltage for the above-described advantage. On the other hand, the liquid crystal display according to the exemplary embodiment of the invention periodically inverts a logic voltage of the up/down signal UP/DOWN, and thus the gate drive ICs 13*a* allows a traveling direction of the gate pulses to change from the downward direction to the upward direction.

Figure 3:
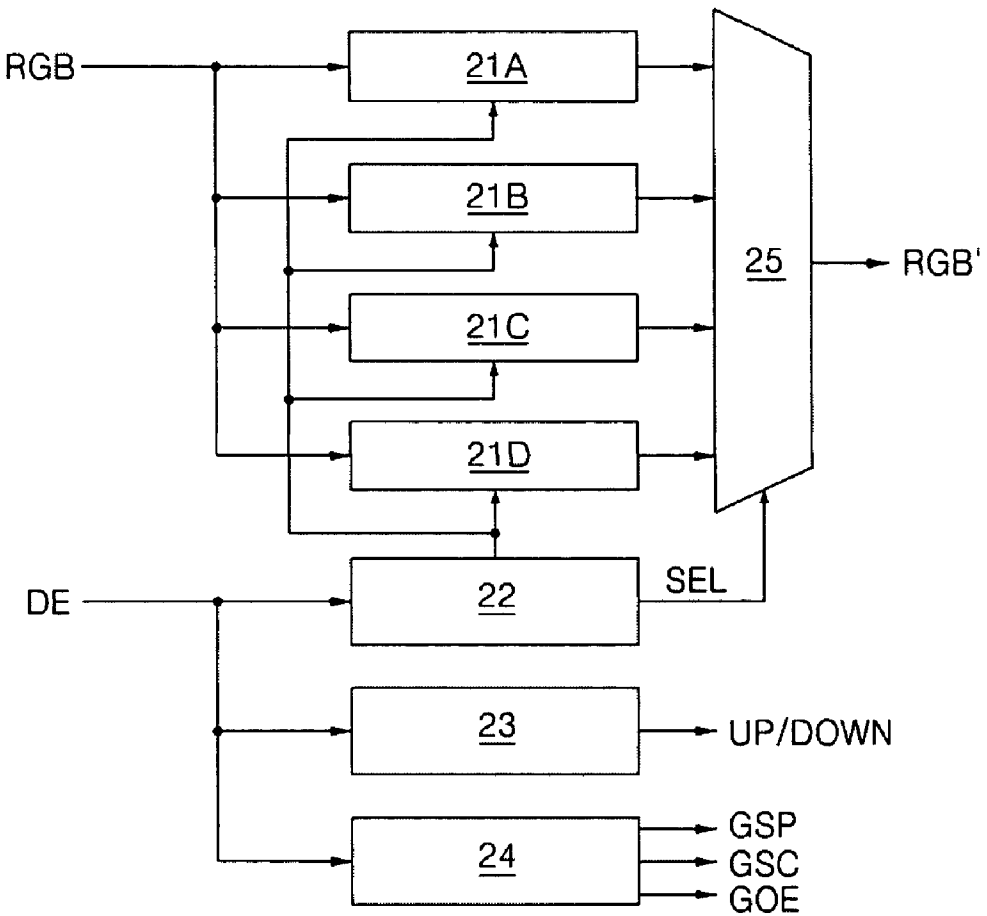
FIG. 3 is a block diagram showing in detail a timing controller.

FIG. 3 shows a circuit unit increasing a transmission frequency of the digital video data in the timing controller 11 and a circuit generation unit generating the gate timing control signal.

As shown in FIG. 3, the timing controller 11 includes first to fourth line memories 21A to 21D, a multiplexer 25, a memory controller 22, an up/down signal generation unit 23, and a gate timing control signal generation unit 24.

The first to fourth line memories 21A to 21D receive the digital video data RGB and divide the digital video data RGB into the number of lines to store the digital video data RGB every 1 line.

The memory controller 22 controls input and output timing of the first to fourth line memories 21A to 21D based on the data enable signal DE and generates a selection signal SEL to control a data output speed of the multiplexer 25. The memory controller 22 controls the multiplexer 25 so as to sequentially output the digital video data RGB stored in the first and second line memories 21A and 21B during 1 horizontal period, and at the same time, stores the digital video data RGB in the third and fourth line memories 21C and 21D so that an output frequency of the data is larger than an input frequency of the data. Further, the memory controller 22 controls the multiplexer 25 so as to sequentially output the digital video data RGB stored in the third and fourth line memories 21C and 21D during 1 horizontal period, and at the same time, stores the digital video data RGB in the first and second line memories 21A and 21B.

The up/down signal generation unit 23 counts the data enable signal DE to estimate an output location of the current gate pulse. The up/down signal generation unit 23 inverts a logic state of the up/down signal UP/DOWN at a change time point of the traveling direction of the gate pulse with reference to previously stored direction change information.

The gate timing control signal generation unit 24 counts the data enable signal DE and allows a frequency of the output signal such as the gate start pulse GSP, the gate shift clock signal GSC, and the gate output enable signal GOE to be two times an existing frequency of the output signal.

Although it is not shown, the timing controller 11 includes a circuit doubling a frequency of the data timing control signal.

Figure 4:
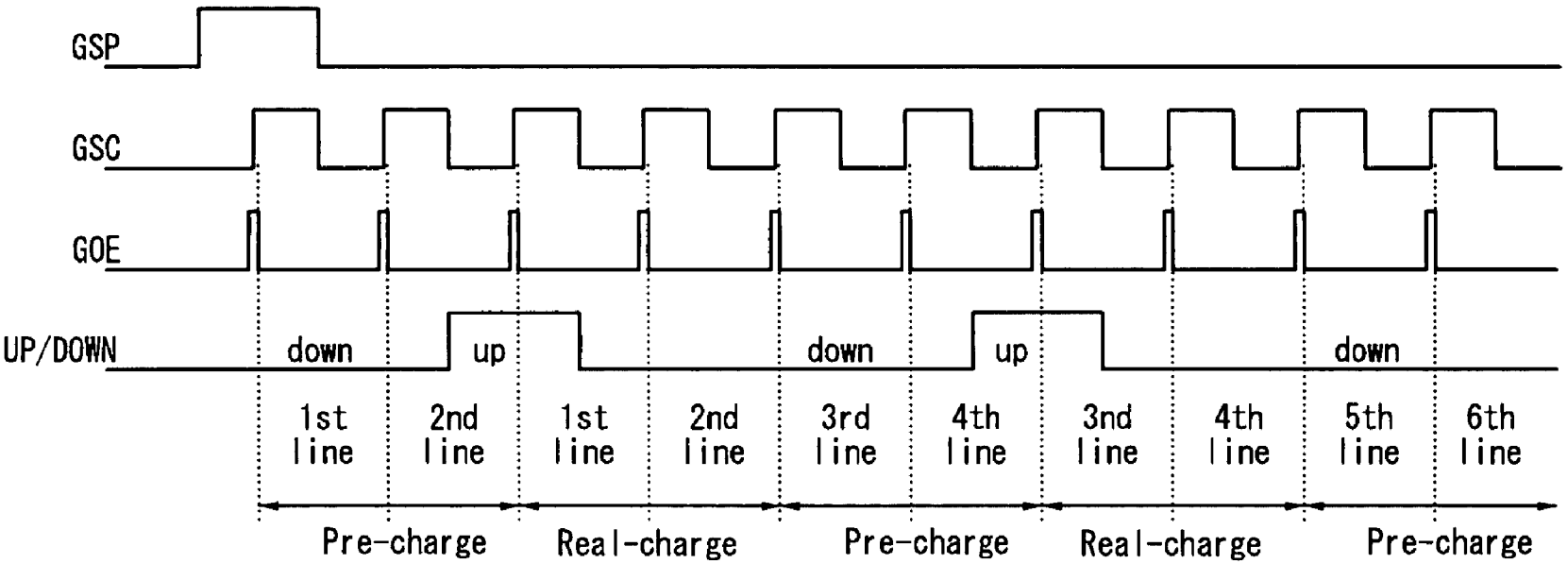
FIG. 4 is a waveform diagram showing a first implementation of a gate timing control signal.

FIG. 4 is a waveform diagram showing a first implementation of the gate timing control signal.

As shown in FIG. 4, the timing controller 11 generates the gate start pulse GSP, the gate shift clock signal GSC, the gate output enable signal GOE, and the up/down signal UP/DOWN. The gate start pulse GSP is once generated every one frame period when the scan lines start to be scanned. Accordingly, the number of generated gate start pulses GSP is equal to the number of scan lines, namely, gate lines. The gate output enable signal GOE is generated in synchronization with a rising edge of the gate shift clock signal GSC. After the up/down signal UP/DOWN is inverted from a low logic state to a high logic state at a falling edge of a second pulse of the gate shift clock signal GSC, the up/down signal UP/DOWN is inverted from a low logic state to a high logic state every 4 pulses of the gate shift clock signal GSC.

Figure 5:
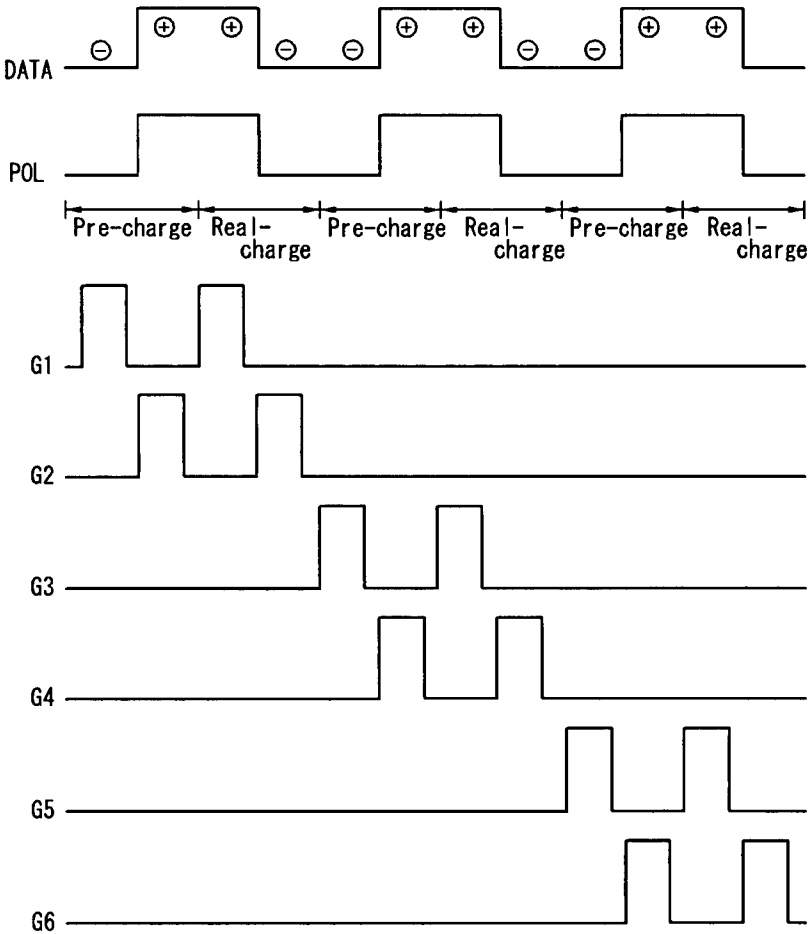
FIG. 5 is a waveform diagram showing a first example of data voltages when the gate drive circuit is driven depending on the gate timing control signal of FIG. 4.
Figure 7:
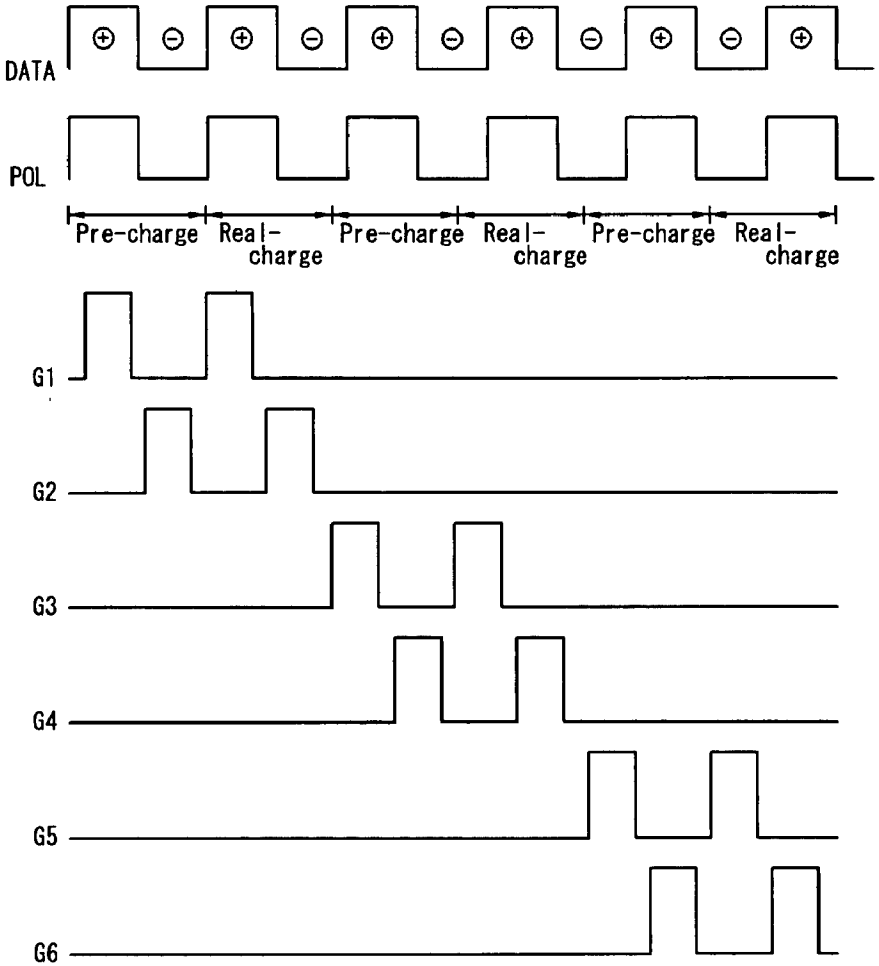
FIG. 7 is a waveform diagram showing a second example of data voltages when the gate drive circuit is driven depending on the gate timing control signal of FIG. 4.

The gate drive circuit 13 shifts the gate pulse in each pulse of the gate shift clock signal GSC to sequentially supply the shifted gate pulse to the gate lines G1 to Gn. When the up/down signal UP/DOWN is in a low logic state, the gate drive circuit 13 shifts the gate pulse in the downward direction traveling from the top to the bottom of the screen. On the other hand, when the up/down signal UP/DOWN is in a high logic state, the gate drive circuit 13 shifts the gate pulse in the upward direction traveling from the bottom to the top of the screen. The number of gate pulses shifted by the gate drive circuit 13 is equal to the number of pulses of the gate shift clock signal GSC. Accordingly, as shown in FIG. 4, if the up/down signal UP/DOWN is generated, the gate drive circuit 13, as shown in FIGS. 5 and 7, sequentially supplies the gate pulses to the first and second gate lines G1 and G2 in the downward direction. Next, the gate drive circuit 13 once shifts the gate pulse in the upward direction to supply the shifted gate pulse to the first gate line G1, and then sequentially supplies the gate pulses to the second to fourth gate lines G2 to G4 in the downward direction. Sequentially, the gate drive circuit 13 once shifts the gate pulse in the upward direction to supply the shifted gate pulse to the third gate line G3, and then sequentially supplies the gate pulses to the fourth to sixth gate lines G4 to G6 in the downward direction. Accordingly, the gate pulse is twice supplied to each of the gate lines G1 to Gn.

A first gate pulse first supplied to the gate line allows the liquid crystal cell to be charged to a pre-charge voltage. A second gate pulse generated subsequent to the first gate pulse allows the liquid crystal cell to be charged to a voltage of data to be displayed. Pre-charge time, during which the pre-charge voltage is supplied to the liquid crystal cell, and real-charge time during which the voltage of data to be displayed is supplied to the liquid crystal cell alternate every scanning time of 2 lines. The up/down signal UP/DOWN is in a high logic state in a boundary between the pre-charge time and the real-charge time to invert a shift direction of the gate pulse.

Figure 6:
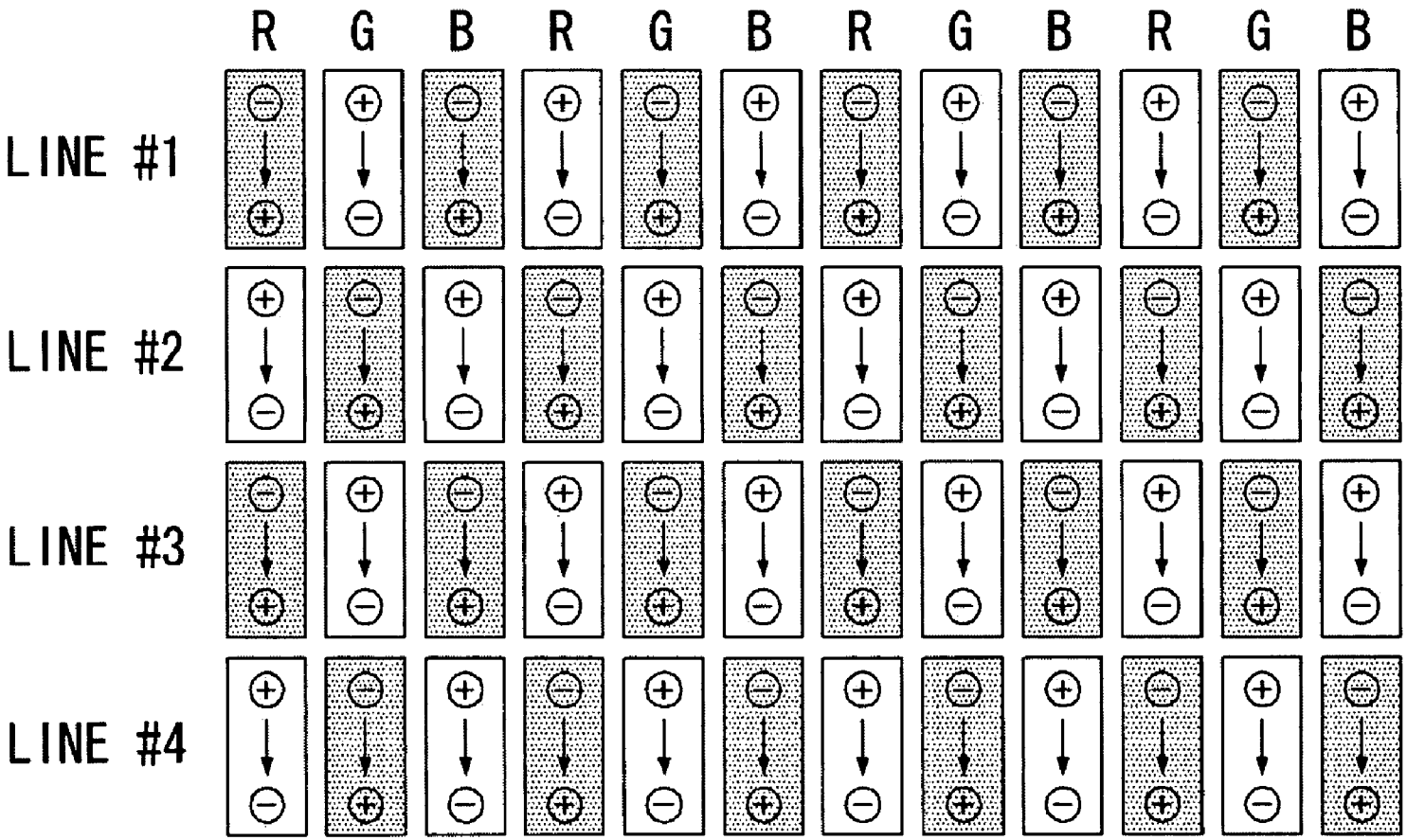
FIG. 6 shows polarities of the data voltages charged to liquid crystal cells when the liquid crystal cells is charged to the data voltages of FIG. 5.

If the polarity control signal POL produced by the timing controller 11 is in a low logic state (during scanning time of 1 line), a high logic state (during scanning time of 2 lines), and a low logic state (during scanning time of 1 line) during scanning time of 4 lines as shown in FIG. 5. After each liquid crystal cell is charged to the data voltage with a polarity opposite a polarity of the data voltage to be displayed as the pre-charge voltage, each liquid crystal cell is charged to the data voltage to be displayed as shown in FIG. 6.

Figure 8:
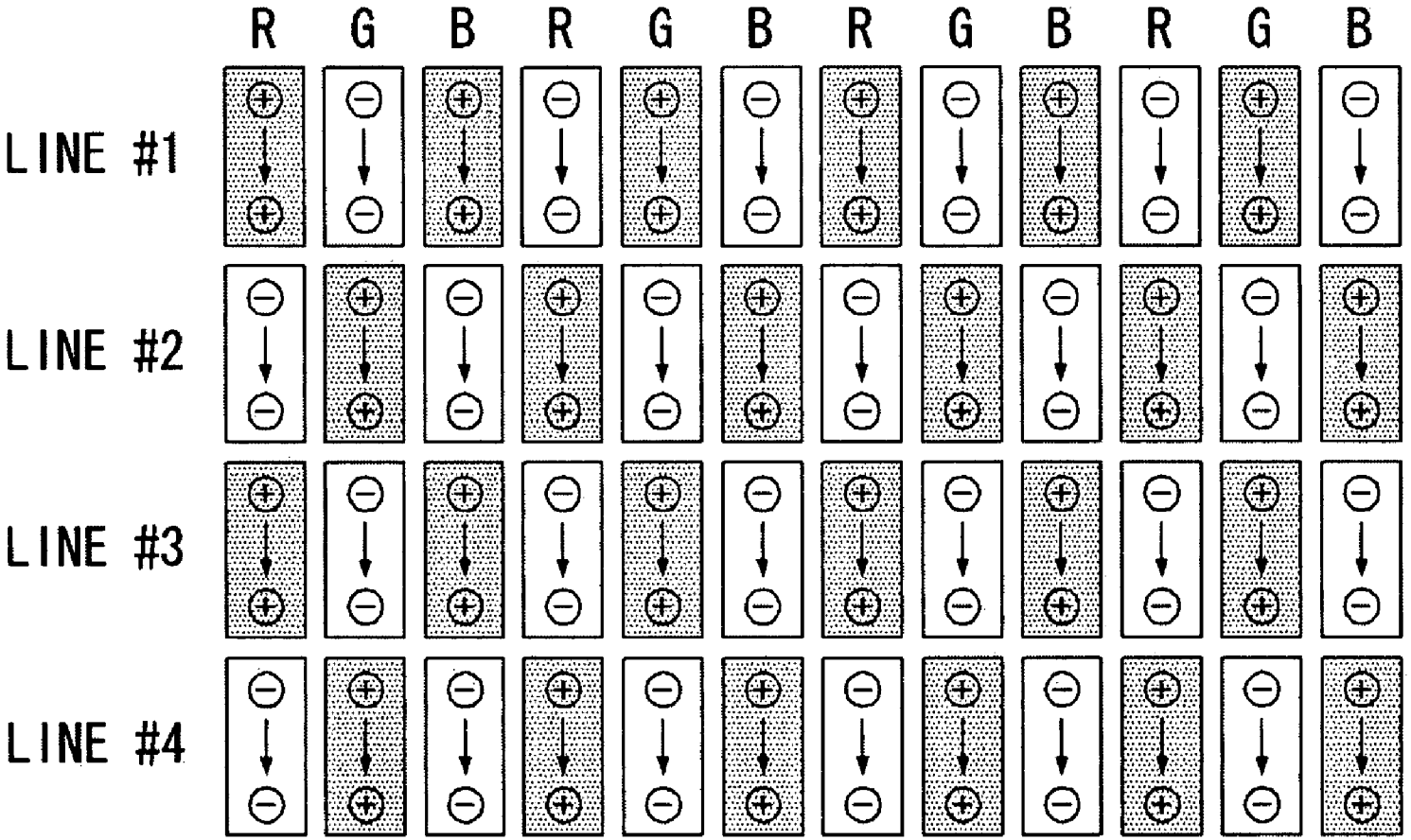
FIG. 8 shows polarities of the data voltages charged to the liquid crystal cells when the liquid crystal cells is charged to the data voltages of FIG. 7.

If a logic state of the polarity control signal POL is inverted every scanning time of 1 line as shown in FIG. 7. After each liquid crystal cell is charged to the data voltage with the same polarity as a polarity of the data voltage to be displayed as the pre-charge voltage, each liquid crystal cell is charged to the data voltage to be displayed as shown in FIG. 8.

Figure 9:
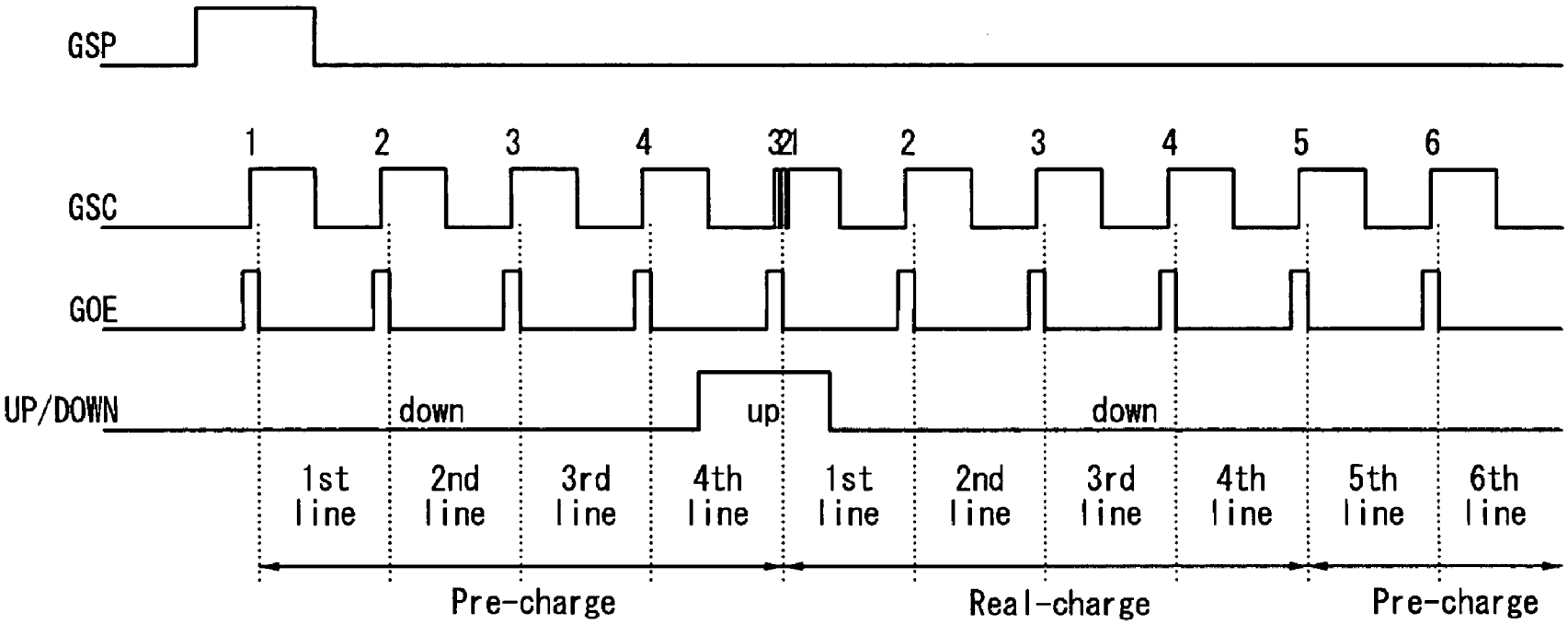
FIG. 9 is a waveform diagram showing a second implementation of the gate timing control signal.

FIG. 9 is a waveform diagram showing a second implementation of the gate timing control signal.

As shown in FIG. 9, the timing controller 11 generates the gate start pulse GSP, the gate shift clock signal GSC, the gate output enable signal GOE, and the up/down signal UP/DOWN. The gate shift clock signal GSC is successively generated four times in the same cycle during scanning time of 4 lines. And then, the fifth to seventh pulses of the gate shift clock signal GSC are successively generated during scanning time of 1 line. Sequentially, eighth to fifteenth pulses of gate shift clock signal GSC are generated in the same cycle during scanning time of 8 lines. After the up/down signal UP/DOWN is inverted from a low logic state to a high logic state at a falling edge of a fourth pulse of the shift clock signal GSC, the up/down signal UP/DOWN is inverted from a low logic state to a high logic state every 8 pulses of the shift clock signal GSC.

Figure 10:
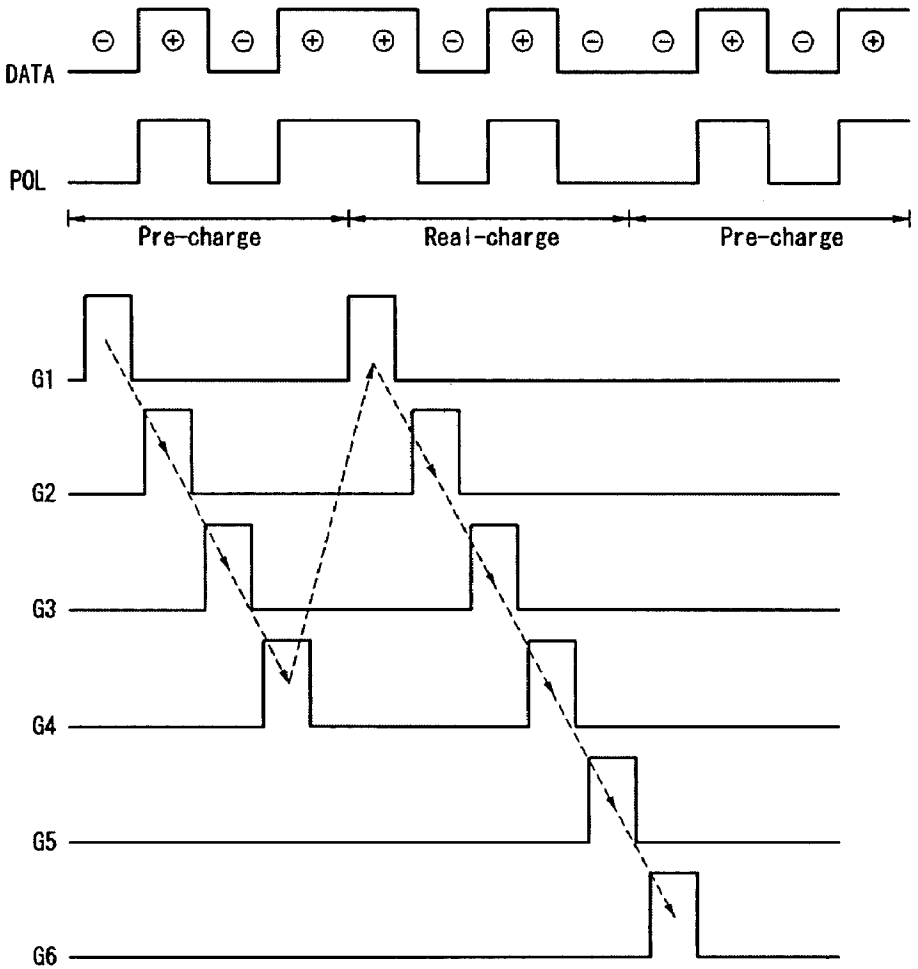
FIG. 10 is a waveform diagram showing a first example of data voltages when the gate drive circuit is driven depending on the gate timing control signal of FIG. 9.
Figure 11:
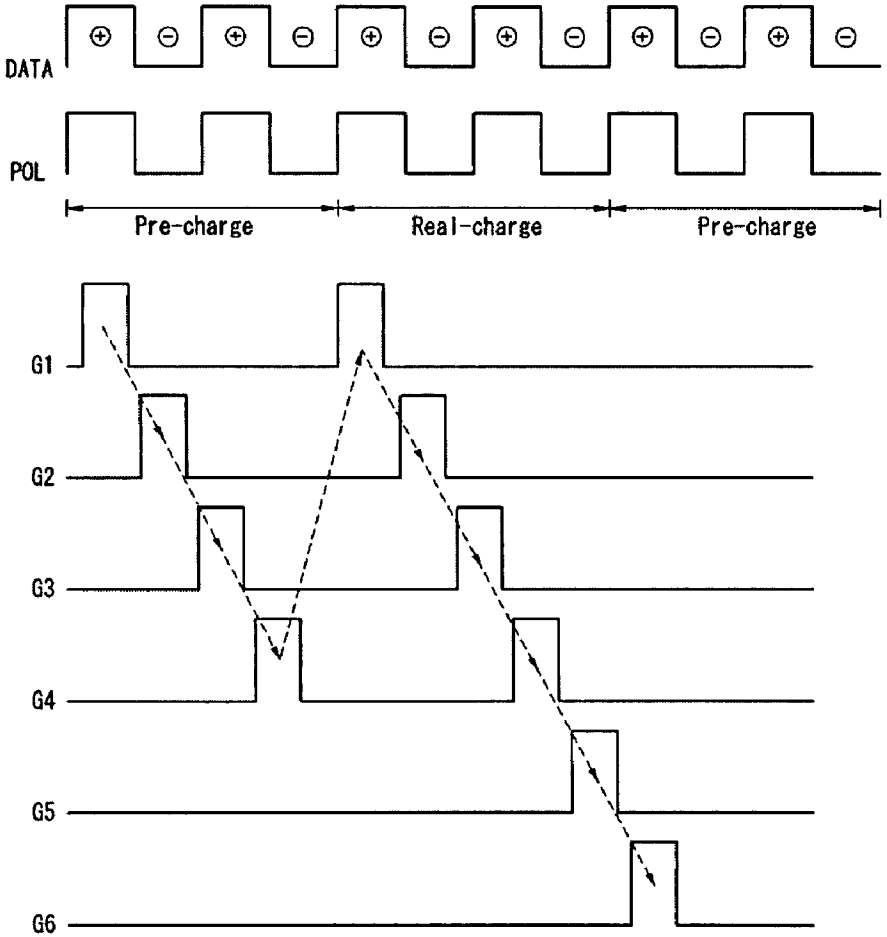
FIG. 11 is a waveform diagram showing a second example of data voltages when the gate drive circuit is driven depending on the gate timing control signal of FIG. 9.

When the up/down signal UP/DOWN is in a low logic state, the gate drive circuit 13 shifts the gate pulse in the downward direction traveling from the top to the bottom of the screen. On the other hand, when the up/down signal UP/DOWN is in a high logic state, the gate drive circuit 13 shifts the gate pulse in the upward direction traveling from the bottom to the top of the screen. The number of gate pulses shifted by the gate drive circuit 13 is equal to the number of pulses of the gate shift clock signal GSC. Accordingly, as shown in FIG. 9, if the up/down signal UP/DOWN is generated, the gate drive circuit 13, as shown in FIGS. 10 and 11, sequentially supplies the gate pulses to the first to fourth gate lines G1 to G4 during pre-charge time in the downward direction. Next, the gate drive circuit 13 shifts the gate pulses three times in the upward direction to sequentially supply the shifted gate pulses to the first to fourth gate lines G1 to G4 in the downward direction for real-charge time. Sequentially, the gate drive circuit 13 sequentially supplies the gate pulses to the fifth to eighth gate lines G5 to G8 in the downward direction during pre-charge time, and then shifts the gate pulses three times in the upward direction to sequentially supply the shifted gate pulses to the fifth to eighth gate lines G5 to G8 in the downward direction for real-charge time. Accordingly, after the first gate pulse is supplied to each of the gate lines G1 to Gn, the second gate pulse is supplied to each of the gate lines G1 to Gn after scanning time of 4 lines.

As shown in FIG. 10, if the polarity control signal POL produced by the timing controller 11 is in a low logic state (during scanning time of 1 line), a high logic state (during scanning time of 1 line), a low logic state (during scanning time of 1 line), and a high logic state (during scanning time of 2 lines) during scanning time of 5 lines, after each liquid crystal cell, as shown in FIG. 6, is charged to the data voltage with a polarity opposite a polarity of the data voltage to be displayed as a pre-charge voltage, each liquid crystal cell is charged to the data voltage to be displayed.

As shown in FIG. 11, if a logic state of the polarity control signal POL is inverted every scanning time of 1 line, after each liquid crystal cell, as shown in FIG. 8, is charged to the data voltage with the same polarity as a polarity of the data voltage to be displayed as the pre-charge voltage, each liquid crystal cell is charged to the data voltage to be displayed.

The data drive circuit 12 converts the digital video data input from the timing controller 11 into positive and positive analog data voltages to supply the positive and positive analog data voltages synchronized with a first gate pulse to the data lines D1 to Dm during the pre-charge time. In other words, in the above-described implementations, the data drive circuit 12 does not generate a separate pre-charge voltage different from the data voltage during the pre-charge time.

In the above-described implementations, when a pre-charge operation is performed every n lines, pre-charge time satisfies the following equation 1.

$$\frac{n}{2} \times H \qquad \text{[Equation 1]}$$

In the above equation 1, n is an integer equal to or larger than 2, and H is 1 horizontal period. For instance, as in the first implementation shown in FIGS. 5 and 7, if a pre-charge operation is performed every 2 lines, pre-charge time required to pre-charge the 2 lines is 1 horizontal period. As in the second implementation shown in FIGS. 10 and 11, if a pre-charge operation is performed every 4 lines, pre-charge time required to pre-charge the 4 lines is 2 horizontal periods.

Accordingly, the liquid crystal display and the method of driving the same according to the exemplary embodiment of the invention, as shown in FIG. 6, once invert the polarity of the data voltage charged to each liquid crystal cell in each frame to suppress the DC drive of the liquid crystal cells, thereby reducing the DC image sticking and the stains. Furthermore, the liquid crystal display and the method of driving the same according to the exemplary embodiment of the invention, as shown in FIG. 8, successively charge the liquid crystal cell in each frame to the data voltages with the same polarity at intervals equal to or longer than scanning time of 1 line to increase a charging speed of the data voltage. Therefore, the liquid crystal display and the method of driving the same according to the exemplary embodiment of the invention suppress the DC drive of the liquid crystal cells as compared with the related art in which the DC voltage is successively applied for a long time, thereby reducing the DC image sticking and the stains.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A liquid crystal display comprising:

a liquid crystal display panel including a plurality of data lines, a plurality of gate lines crossing the data lines, and a plurality of liquid crystal cells;

a data drive circuit that generates a pre-charge data voltage during pre-charge time and generates a real-charge voltage to be displayed on the liquid crystal display panel during real-charge time;

a gate drive circuit that supplies a first gate pulse synchronized with the pre-charge data voltage to the gate lines during the pre-charge time while shifting the first gate pulse in a downward direction and an upward direction depending on an up/down signal two or more times within 1 frame period for every frame period, and then supplies a second gate pulse synchronized with the real-charge data voltage to the gate lines from a falling edge of the first gate pulse at intervals equal to or longer than scanning time of 1 line during the real-charge time; and a timing controller that generates a gate start pulse indicating a scan start horizontal line of a scan operation in the 1 frame period, a gate shift clock signal shifting the gate start pulse, a gate output enable signal indicating an output of the gate drive circuit, and the up/down signal indicating an output order of the first gate pulse, wherein the timing controller inverts a logic state of the up/down signal two or more times during 1 frame period and controls operation timing of the data drive circuit and the gate drive circuit, wherein a polarity of the pre-charge data voltage is opposite to or the same as a polarity of the real-charge data voltage.

2. The liquid crystal display of claim 1, wherein after the gate drive circuit sequentially supplies the first gate pulse to first and second gate lines in response to the up/down signal during first pre-charge time, the gate drive circuit sequentially supplies the second gate pulse to the first and second gate lines during first real-charge time, and then sequentially supplies the first gate pulse to third and fourth gate lines during second pre-charge time.

3. The liquid crystal display of claim 2, wherein the timing controller generates a gate start pulse indicating a start line on which the first gate pulse starts to be generated, a gate shift clock signal shifting the gate start pulse, and a gate output enable signal controlling an output of the gate drive circuit, and a pulse in a high logic state of the up/down signal overlaps 1 clock of the gate shift clock signal.

4. The liquid crystal display of claim 1, wherein after the gate drive circuit sequentially supplies the first gate pulse to first to fourth gate lines in response to the up/down signal during first pre-charge time, the gate drive circuit sequentially supplies the second gate pulse to the first to fourth gate lines during first real-charge time, and then sequentially supplies the first gate pulse to fifth to eighth gate lines during second pre-charge time.

5. The liquid crystal display of claim 4, wherein the timing controller generates a gate timing control signal including a gate start pulse indicating a start line on which the first gate pulse starts to be generated, a gate shift clock signal shifting the gate start pulse, and a gate output enable signal controlling an output of the gate drive circuit, and a pulse in a high logic state of the up/down signal overlaps 3 clocks of the gate shift clock signal.

6. The liquid crystal display of claim 5, wherein the timing controller receives digital video data and doubles a transmission frequency of the digital video data to supply the digital video data with the doubled transmission frequency to the data drive circuit, and the timing controller controls the gate drive circuit so that a frequency of the gate timing control signal doubles, and controls the data drive circuit so that a frequency of a data timing control signal for controlling operation timing of the data drive circuit doubles.

7. A method of driving a liquid crystal display including a liquid crystal display panel including a plurality of data lines, a plurality of gate lines crossing the data lines, and a plurality of liquid crystal cells, the method comprising:

generating a gate start pulse indicating a scan start horizontal line of a scan operation in the 1 frame period, a gate shift clock signal shifting the gate start pulse, a gate output enable signal indicating an output of the gate drive circuit, and an up/down signal indicating an output order of a first gate pulse to be supplied to the gate lines, wherein a logic state of the up/down signal is inverted two or more times during 1 frame period;

generating a pre-charge data voltage during pre-charge time and generating a real-charge voltage to be displayed on the liquid crystal display panel during real-charge time;

supplying the first gate pulse synchronized with the pre-charge data voltage to the gate lines during the pre-charge time while the first gate pulse is shifted in a downward direction and an upward direction depending on the up/down signal two or more times within 1 frame period for every frame period; and supplying a second gate pulse synchronized with the real-charge data voltage to the gate lines from a falling edge of the first gate pulse at intervals equal to or longer than scanning time of 1 line during the real-charge time, wherein a polarity of the pre-charge data voltage is opposite to or the same as a polarity of the real-charge data voltage.

* * * * *